United States Patent [19]

Oikawa

[11] Patent Number: 4,795,371

[45] Date of Patent: Jan. 3, 1989

[54] CONNECTOR

[75] Inventor: Ryuetsu Oikawa, Kosai, Japan

[73] Assignee: Yazaki Corporation, Tokyo, Japan

[21] Appl. No.: 57,102

[22] Filed: Jun. 3, 1987

[30] Foreign Application Priority Data

Jun. 12, 1986 [JP] Japan ..... 61-088493[U]

[51] Int. Cl.[4] ..... H01R 13/44; H01R 13/428

[52] U.S. Cl. ..... 439/595; 439/871

[58] Field of Search ..... 439/593, 595, 871–873, 439/884, 843, 848, 908

[56] References Cited

U.S. PATENT DOCUMENTS 4,571,017 2/1986 Fujita ..... 439/871

4,732,437 3/1988 Vandame ..... 439/871

*Primary Examiner*—Gil Weidenfeld

*Assistant Examiner*—Paula A. Austin

*Attorney, Agent, or Firm*—Armstrong, Nikaido, Marmelstein & Kubovcik

[57] ABSTRACT

A connector comprising contacting terminals; terminal-containing chambers for accommodating the contacting terminals, each one of the terminal-containing chambers having a resilient connection arm which is provided within the chamber for resiliently securing the contacting terminal, the connection arm defining a space between the back surface of itself and the inner wall of the terminal-containing chambers; and a terminal having contacting-pieces and a spacer which are integrally constructed in parallel to each other and are extending in the same direction, the contacting-pieces being inserted into contact with the contacting terminals and the spacer into the space for fitting therein.

1 Claim, 2 Drawing Sheets

CONNECTOR

BACKGROUND OF THE INVENTION

1. Field of The Invention

This invention relates to a connector for connecting lead conductors.

2. Description of The Prior Art

Efficient wiring is required in making electrical connections at a time among wires when wiring work involves a number of branches. In the art, there have been lumped connectors in which a plurality of connecting -terminals bonded fixedly to the ends of conductive wires are first inserted into a connector housing, and then a lumped contactor is inserted for making connections among these terminals through contact engagement with respective terminals thereby accomplishing electrical connection at a time.

Such a lumped connector has a plurality of terminal-containing chambers disposed in lines. Terminals such as female terminals bonded fixedly to the ends of the conductors are respectively inserted into the terminal-containing chambers in one direction, then a lumped contactor in which a plurality of contacting pieces are so projected in a pectinated shape as to be simultaneously inserted into the respective terminal-containing chambers are inserted thereinto to connect the contacting pieces to the respective female terminals for completing the contacts among the conductors through the contactor.

In the connectors of this type, the contacting pieces are disposed in equal space, but the inserting positions of the connecting-terminals in the terminal-containing chambers are slightly different from one to another within a tolerance.

If an unreasonable force is applied to some of the connecting terminals when the contactor is to be inserted, then incomplete fitting often occurs and causes troubles leading to the dropping-out of the terminals.

An improved technique in a multipolar connector, which is disclosed in Japanese Utility Model Publication No. 61-1666, can be utilized as a means for preventing the terminals from dropping out. In this conventional connector, as shown in FIGS. 3 to 5, a female connecting terminal C1 is inserted into a male housing A and held firmly by a resilient connecting piece al, and a male connector C2 is inserted into female housing B and held firmly by a resilient connection piece b1.

A deflecting gap a2 formed on the back surface of the resilient connection piece a1, and a deflecting gap b2 formed on the back surface of the resilient connection piece b1 are opposed, and a common spacer D is inserted into the gaps. The spacer D is inserted at its base portion d1 into the deflecting gap b2 and at its front portion d2 into the deflecting gap a2.

The front and rear ends thereof are tapered for smooth insertion.

In this conventional connector, if the connecting terminals are inserted normally into the housing, then the spacer can be inserted, thereby sure insertion of connecting terminals is obtained and the connecting terminals will not drop out. However, since the spacer and the housing are two separate components, the connector's cost increases due to the management and assembly work of the parts of the connector. Further, due to the errors in dimension and fitting, high reliability as expected may not necessarily be obtained.

SUMMARY OF THE INVENTION

An object of this invention is to provide a connector which can readily and easily be assembled and does not result in dropping-out of its terminals.

In order to achieve this and other objects, there is provided a connector comprising contacting terminals;

terminal-containing chambers for accommodating said contacting terminals, each of said terminal-containing chambers having a resilient connection arm which is provided within the chamber for resiliently securing the contacting terminals, said connection arm defining a space between the back surface of itself and the inner wall of the terminal-containing chambers; and a terminal having contacting-pieces and a spacer which are integrally constructed in parallel to each other and are extending in the same direction, said contacting-pieces being inserted into contact with said contacting terminals and said spacer into said space. Other and further objects, features and advantages of the invention will appear more fully from the following description.

DETAILED DESCRIPTION OF THE PREFERRED EMBODIMENTS

Figure 1:
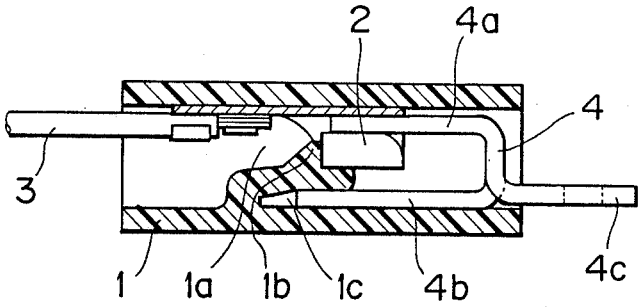
FIG. 1 is a sectional view showing the construction an embodiment of a connector according to the present invention.

The most preferable embodiment of the present invention will be described in detail with reference to FIGS. 1 and 2.

A connector comprises a housing 1 in which a plurality of terminal-containing chambers 1*a* are formed in a line. A resilient connection arm 1*b* is projected from the side wall in the terminal-containing chamber 1*a* to firmly hold a contacting terminal 2 bonded firmly to the end of a conductor 3.

Figure 2:
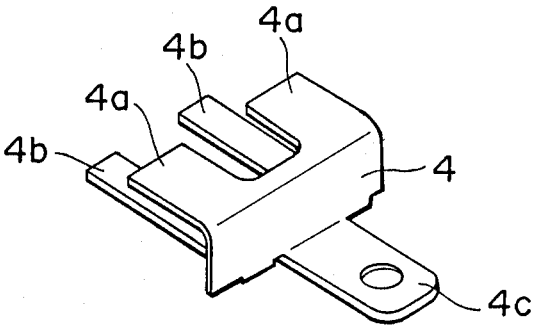
FIG. 2 is a perspective view of a terminal used for the connector.
Figure 3:
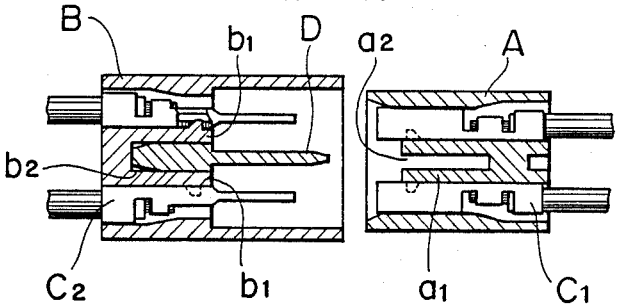
FIG. 3 Prior Art
FIG. 3 is a sectional view of an example of a multipolar connector having a terminal removal preventing structure of the prior art.
Figure 4A:
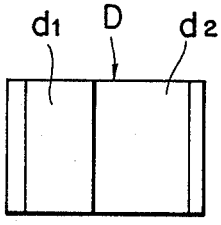
FIG. 4a Prior Art
FIGS. 4*a* and 4*b* are plan and front views of a space used for the multipolar connector.
Figure 4B:
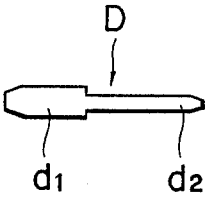
FIG. 4b Prior Art
Figure 5:
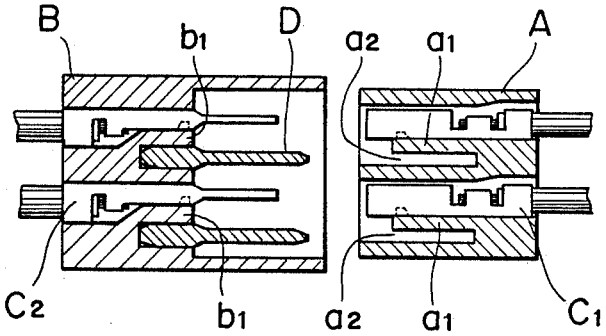
FIG 5 Prior Art
FIG. 5 is a sectional view of another example of the conventional multipolar connector.

The connector also comprises a lumped terminal 4 as shown in FIG. 2. The terminal 4 has a pair of contacting pieces 4*a* and 4*a* to be inserted into the contacting terminal 2, and a pair of spacer pieces 4*b* and 4*b* to be connected into a deflecting space 1*c* formed on the back surface side of the connection arm 1.

The contacting pieces 4*a* and 4*a*, and the spacer pieces 4*b* and 4*b* are projected from the terminal body in parallel to each other . The lumped terminal also has a connection piece 4*c* to be connected, for example, to ground.

In the connector of this invention constructed a described above, the connecting terminals 2 are disposed in a line and inserted into the housing 1.

When the lumped terminal 4 is to be inserted into the housing 1 in the direction opposite to the connecting terminals 2, the contacting pieces 4*a* are inserted into the connecting terminal 2, and spacer pieces 4*b* are inserted into the deflecting space 1*c* thus preventing the back-deflection of the resilient connection arm 1*a* which leads to disconnection of the connecting terminal 2 from the resilient connection arm.

Further, once the lumped terminal 4 is inserted completely, the connecting terminal 2 is not removed from the resilient connection arm 1*a* even if it is pulled by a strong force.

Still further, since the contacting pieces 4*a* and the spacer pieces 4*b* are integrally formed with high accuracy in dimension, the connecting terminal 2 can reliably be connected to the lumped terminal 4 without being inaccurately aligned with the contacting pieces 4*a*.

By means of a lumped terminal formed in a specific shape, the connector according to the present invention is enhanced sure fitting of its contact pins in pin-accommodating spaces disposed in a specific way.

Since the terminals can reliably be connected, the invention markedly improves not only reliability against troubles such as dropping-out of the pins but also workability in assembly by virtue of easy mounting of the pins etc.

In addition, the reduced number of parts of the connector can save the management cost of the parts.

What is claimed is:

1. A connector consisting of at least one contacting terminal;

at least one unitarily constructed terminal comprising contacting pieces and a spacer which are integrally constructed in parallel to each other and extend in the same direction, said contacting pieces being contactable with a respective said at least one contacting terminal;

a housing defining at least one terminal-containing chamber, each said terminal-containing chamber receivable of a respective contacting terminal and a respective terminal, said terminal-containing chamber having an inner wall and a resilient connection arm extending into said terminal-containing chamber for resiliently engaging and securing said contacting terminal in said terminal-containing chamber, said resilient connection arm defining a space between a back surface of said resilient connection arm and said inner wall, said resilient connection arm deformable into said space, said contacting pieces of said terminal contacting said contacting terminal and said spacer being received within said space to prevent deformation of said resilient connection arm when said respective contacting terminal and said respective terminal are received within said terminal-containing chamber.

* * * * *